US006519800B2

(12) United States Patent
Newman et al.

(10) Patent No.: US 6,519,800 B2
(45) Date of Patent: Feb. 18, 2003

(54) PAINT ROLLER FRAME WITH SHIFTABLE ARM

(75) Inventors: Robert D. Newman, Greenwood, MO (US); Buford J. Guittar, Greenwood, MO (US)

(73) Assignee: Specialty Products of Greenwood, Missouri Inc., Greenwood, MO (US); part interest ( * ) Notice: Subject to any disclaimer, the term of this patent is extended or adjusted under 35 U.S.C. 154(b) by 47 days.

(21) Appl. No.: 09/876,308

(22) Filed: Jun. 7, 2001

(65) Prior Publication Data

US 2002/0187888 A1 Dec. 12, 2002

(51) Int. Cl.[7] ..... B05C 17/02
(52) U.S. Cl. ..... 15/230.11; 15/152; 492/13
(58) Field of Search ..... 15/151, 152, 230, 15/230.11; 492/13, 19; D4/122

(56) References Cited

U.S. PATENT DOCUMENTS

| | | | | |
|---|---|---|---|---|
| 850,317 | A | * | 4/1907 | Rdigely |
| 2,305,352 | A | * | 12/1942 | Helminiak |
| 2,811,733 | A | | 11/1957 | Sloan |
| 2,845,643 | A | * | 8/1958 | Provencal et al. |
| 2,885,707 | A | * | 5/1959 | Vogt |
| 2,954,575 | A | * | 10/1960 | Rones et al. |
| 3,227,496 | A | * | 1/1966 | Johnson |
| 3,310,831 | A | | 3/1967 | Brinker |
| 3,593,361 | A | | 7/1971 | Welt |
| 3,745,624 | A | * | 7/1973 | Newman |
| 3,906,581 | A | * | 9/1975 | Marino et al. |
| 3,937,583 | A | | 2/1976 | Tyson et al. |
| D293,860 | S | | 1/1988 | Smith |
| 4,868,946 | A | | 9/1989 | Marino |
| D332,009 | S | | 12/1992 | Kiefer |
| 5,921,905 | A | | 7/1999 | Newman, Jr. et al. |

FOREIGN PATENT DOCUMENTS

| | | | |
|---|---|---|---|
| WO | WO 94/00245 | * | 1/1994 |

* cited by examiner

*Primary Examiner*—Terrence R. Till
(74) *Attorney, Agent, or Firm*—Hovey Williams LLP

(57) ABSTRACT

A frame for holding a paint roller including a body, a shiftable arm coupled to the body, and a biasing mechanism operable to automatically shift the shiftable arm relative to the body when actuated.

18 Claims, 2 Drawing Sheets

PAINT ROLLER FRAME WITH SHIFTABLE ARM

BACKGROUND OF THE INVENTION

1. Field of the Invention

The present invention relates generally to frames for supporting paint rollers. The invention further concerns a paint roller frame having a quick-release shiftable arm.

2. Discussion of Prior Art

Paint rollers are useful for a variety of painting applications. Paint rollers are typically supported for rotation by a frame which is coupled to an elongated handle. During, or between, painting operations it is frequently necessary to remove the roller from the frame for cleaning or replacement.

In the past, several configurations existed for facilitating removal of the roller from the frame. For example, some prior art frames are made of a resilient material which allows the roller to be disengaged from the frame by bending the frame. Other prior art frames include complex mechanisms for adjusting the width of the frame.

However, frames which include complex width-adjusting mechanisms are typically too expensive to be commercially practical. Frames which require bending to remove the roller can be difficult to operate without contacting the paint-soaked roller with undesired items. Further, frames requiring bending for roller removal run the risk of fracturing due to stress and/or fatigue.

SUMMARY OF THE INVENTION

In one embodiment of the present invention an adjustable frame for holding a paint roller is provided. The adjustable frame includes a body, a shiftable arm, and a biasing mechanism. The shiftable arm is coupled to the body and shiftable relative to the body. The biasing mechanism is operable to automatically shift the shiftable arm when actuated.

In another embodiment of the present invention a method of changing paint rollers supported by a roller frame is provided. The method includes the step of depressing a button on the roller frame to thereby activate the automatic shifting of a shiftable arm of the frame to an extended position in which a roller is at least partly decoupled from the frame.

In another embodiment of the present invention a method of assembling an adjustable paint roller frame is provided. The method comprises the steps of: (a) sliding a shiftable arm into a first end of a tubular body; (b) extending a depressible button through a slot in the tubular body; and (c) coupling the depressible button to a resilient bar extending from the shiftable arm.

The system of the present invention provides a quick-release adjustable frame which is inexpensive and easy to manufacture, assemble, and operate. Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figures 4, 5, 6, 7, 8:
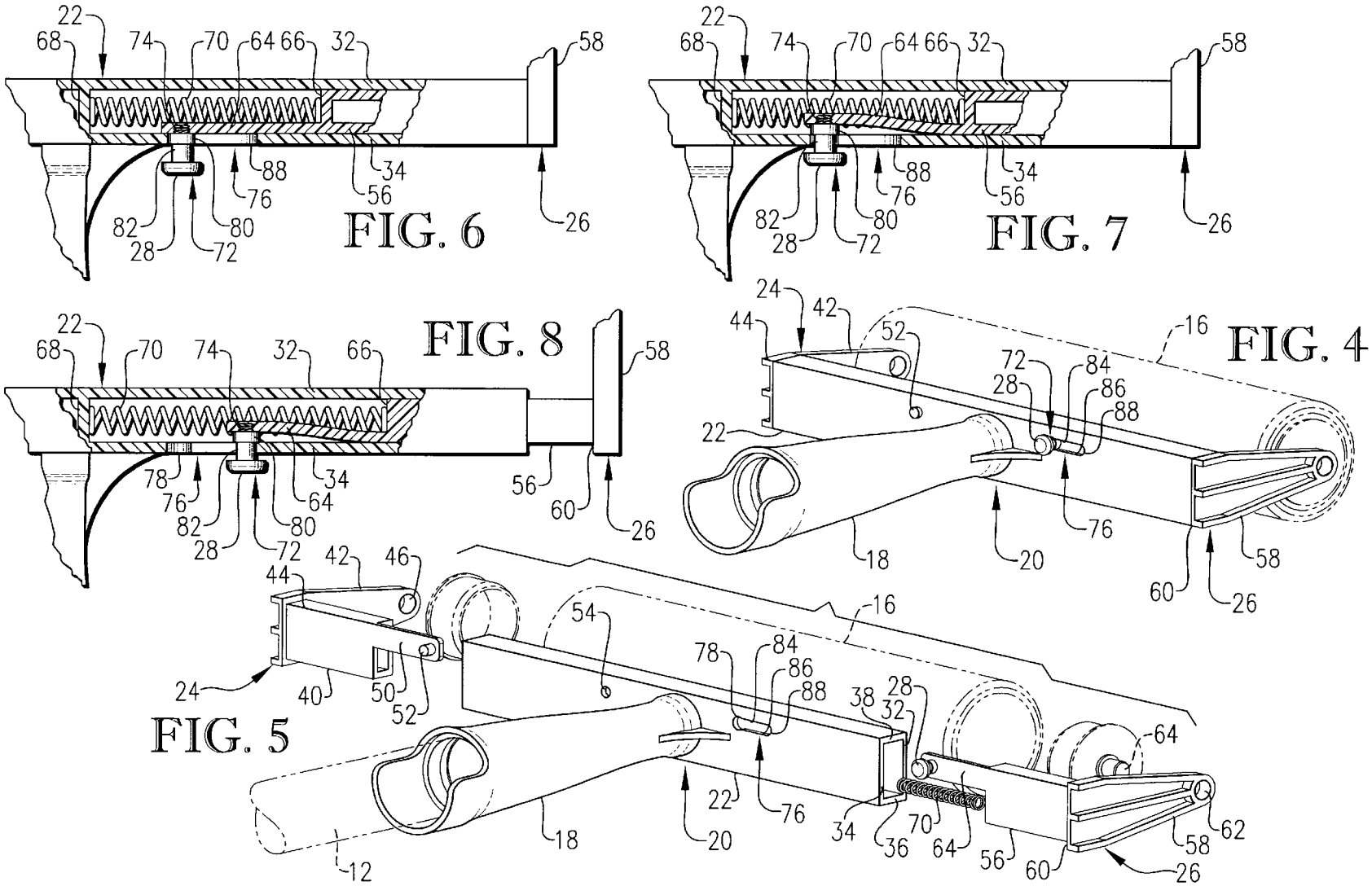
FIG. 4 is a perspective view of an adjustable frame showing the handle-side surface of the adjustable frame.
FIG. 5 is an exploded view of the adjustable frame shown in FIG. 4.
FIG. 6 is a cutaway view of an adjustable frame showing the biasing mechanism, locking mechanism, and depressible button with the shiftable arm being in the retracted position and the locking mechanism being in the locked position.

FIG. 7 is a cutaway view of an adjustable frame showing the biasing mechanism, locking mechanism, and depressible button with the shiftable arm being in the retracted position and the depressible button being depressed so as to shift the locking mechanism into an unlocked position; and FIG. 8 is a cutaway view of an adjustable frame showing the biasing mechanism, locking mechanism, and depressible button with the shiftable arm being in the extended position and the locking mechanism being in the unlocked position.

DETAILED DESCRIPTION OF THE PREFERRED EMBODIMENTS

Figures 1, 2, 3:
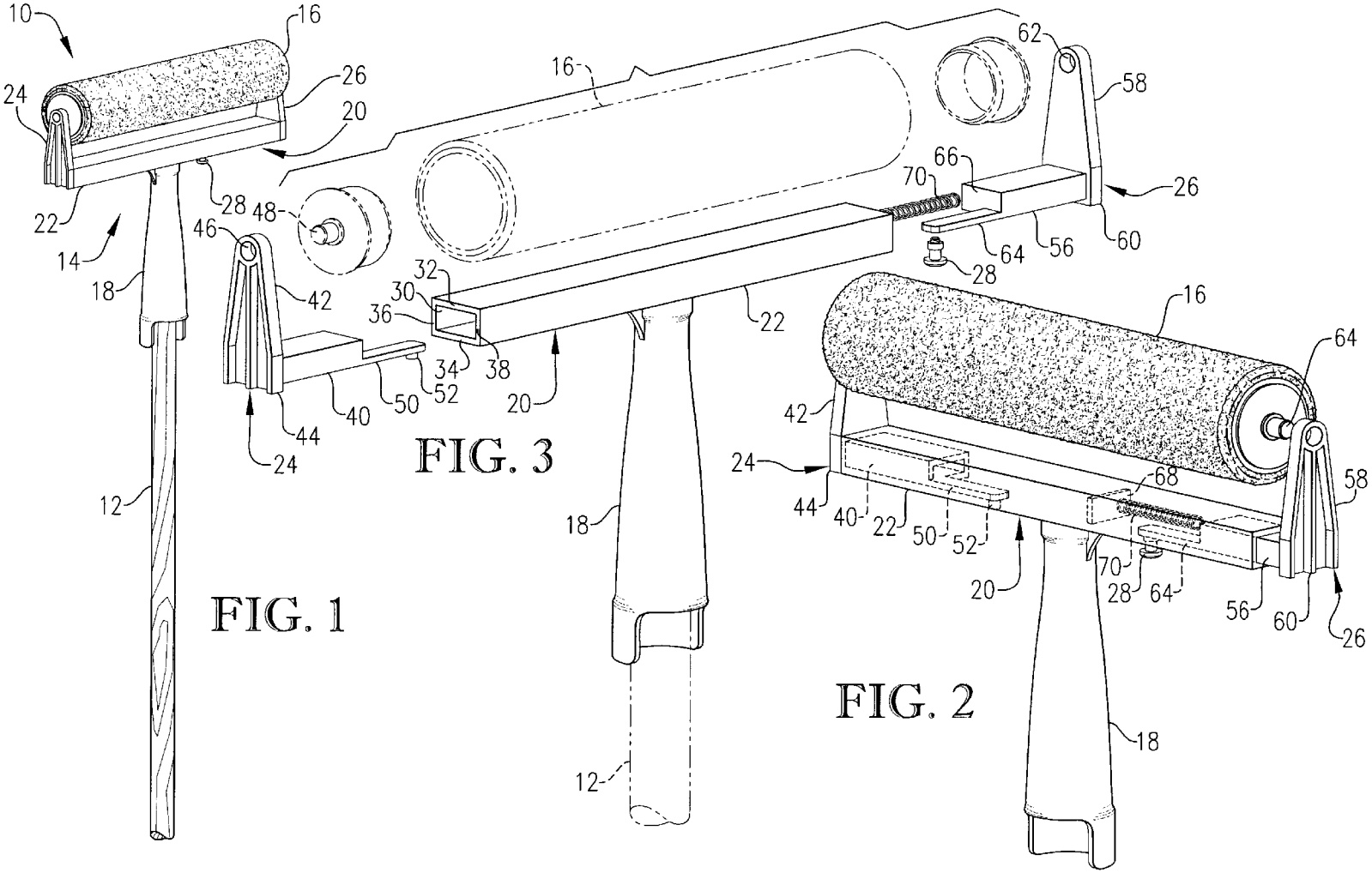
FIG. 1 is a perspective view of a paint rolling tool which includes a paint roller supported by an adjustable frame coupled to an elongated handle.
FIG. 2 is a perspective view showing an adjustable frame and a paint roller with a shiftable arm of the frame being decoupled from the paint roller in an extended position.
FIG. 3 is an exploded view of an adjustable frame and roller.

Turning now to the drawing figures, and particularly FIG. 1, a paint rolling tool 10 constructed in accordance with a preferred embodiment of the present invention is illustrated. The paint rolling tool includes an elongated handle 12, a roller holder 14, and a paint roller 16. Roller holder 14 includes a handle socket 18 for receiving handle 12 and coupling roller holder 14 and handle 12 to one another. Handle socket 18 is preferably constructed as described in pending U.S. patent application Ser. No. 09/493,296 filed Jan. 28, 2000, the entire disclosure of which is hereby incorporated by reference. Handle socket 18 preferably can be coupled to a variety of types of handles or extension poles. Roller holder 14 further includes an adjustable frame 20 having an elongated tubular main body 22, a fixed arm 24, and a shiftable arm 26. Body 22 is preferably oriented so that the direction of elongation of body 22 is transverse to the direction of elongation of handle 12. Arms 24 and 26 are preferably configured to extend from body 22 in a direction which is transverse to the direction of elongation of body 22. Paint roller 16 is spaced from body 22 and supported for rotation relative to body 22 by fixed arm 24 and shiftable arm 26. As described in detail below, roller holder 14 includes a depressible button 28 which, when depressed, actuates the automatic shifting of shiftable arm 26 to an extended position relative to body 22, to thereby at least partially decouple paint roller 16 from adjustable frame 20. The term "automatic" or "automatically" as used herein with respect to the shifting of a component of frame 20 means that the shifting occurs without requiring the application of a manual force during the shifting motion. In other words, although a manual force may be required to initiate or actuate the shifting (e.g., manually pressing button 28), the force behind the actual shifting motion is provided by a means other than manual force.

Referring now to FIGS. 2–5, adjustable frame 20 of roller holder 14 is illustrated in detail. Body 22 of frame 20 is preferably a generally rectangular elongated tubular member having a channel 30 which is defined by the interior surfaces of a roller-facing wall 32, a handle-facing wall 34, and opposing sidewalls 36 and 38. Body 22 is adapted to receive at least a portion of fixed arm 24 and shiftable arm 26 in channel 30. Body 22 is preferably formed with substantially no openings in roller-facing wall 32 and sidewalls 36 and 38 to thereby at least substantially prevent the entry of paint from roller 16 and other debris into channel 30.

Fixed arm 24 of adjustable frame 20 includes a base portion 40 and an end portion 42 which are joined at an elbow 44. Base portion 40 and end portion 42 preferably extend from elbow 44 at least substantially perpendicular to one another. End portion 42 includes an opening 46 which is spaced from elbow 44 and is adapted to receive an axle 48 of paint roller 16. Base portion 40 of fixed arm 24 is adapted to be at least partly slidably received in channel 30 of body 22. Preferably, base 40 presents an outer surface that fits in registry with the inner surface of body 22 defining channel 30. Fixed arm 24 includes a resilient bar 50 coupled to base 40 and extending therefrom. As perhaps best seen in FIG. 5, bar 50 includes a projection 52 which is adapted to be received in a hole 54 formed in handle facing wall 34 of body 22 to thereby fix arm 24 relative to body 22.

Shiftable arm 26 of adjustable frame 20 includes a base portion 56 and an end portion 58 which are joined at an elbow 60. Base portion 56 and end portion 58 preferably extend from elbow 60 at least substantially perpendicular to one another. End portion 58 includes an opening 62 which is adapted to receive an axle 64 of paint roller 16. Base portion 56 is at least partially slidably received in channel 30 of body 22 to thereby allow for shifting of shiftable arm 26 relative to body 22. Base portion 56 preferably presents an outer surface adapted to be slidably received in registry with the inner surface of body 22 defining channel 30.

A resilient bar 64 is coupled to and extends from an inner face 66 of base portion 56. A stop 68, best seen in FIG. 2, is received in and fixedly coupled to body 22. Stop 68 projects transversely across at least a portion of channel 30 proximate shiftable arm 26. A spring 70 is disposed between and engages stop 68 and inner face 66. When shiftable arm 26 is in the retracted position, as shown in FIG. 4, spring 70 is compressed between stop 68 and inner face 66. Spring 70 is operable to urge shiftable arm 26 toward an extended position relative to body 22, as shown in FIG. 2. When actuated, spring 70 is at least partly released and automatically shifts shiftable arm 26 to the extended position.

As perhaps best seen in FIGS. 4–8, a locking mechanism 72 is coupled to resilient bar 64 and is shiftable between a locked position, shown in FIG. 6, and an unlocked position, shown in FIGS. 7–8. Locking mechanism 72 is operable to hold shiftable arm 26 in a retracted position, as shown in FIG. 6. Locking mechanism 72 includes a threaded portion 74 adapted to threadably engage resilient bar 64 to thereby couple locking mechanism 72 to resilient bar 64. Locking mechanism 72 is at least partially received an elongated slot 76 which is formed in handle facing wall 34 of body 22. Elongated slot 76 includes a wide end 78 which receives a wide portion 80 of locking mechanism 72 when shiftable arm 26 is in the retracted position. When wide end 78 of slot 76 and wide portion 80 of locking mechanism 72 are engaged in a locked position, the force provided by spring 70 which urges shiftable arm 26 toward the extended position is restrained and shiftable arm 26 is locked in the retracted position.

Locking mechanism 72 further includes depressible button 28 which, when depressed, disengages wide portion 80 of locking mechanism 72 and wide end 78 of elongated slot 76 to thereby shift locking mechanism 72 to an unlocked position and actuate spring 70. When wide portion 80 is disengaged from wide end 78, the force provided by spring 70 which urges shiftable arm 26 towards the extended position is no longer counteracted by locking mechanism 72 and shiftable arm 26 is free to automatically slide relative to body 22 into the extended position. As shiftable arm 26 slides into the extended position, a narrow portion 82 of locking mechanism 72 slides within a narrow section of slot 76 defined by opposing sides 84 and 86 and comes to rest in a narrow end 88 of slot 76.

All components of adjustable frame 20, with the exception of spring 70, are preferably formed of a relatively durable and light weight synthetic resin material. The material of construction for resilient bars 50 and 64 can be any material capable of being repeatedly flexed without fracturing or losing resilience.

As best seen in FIGS. 6–8, the configuration of body 22, shiftable arm 26, resilient bar 64, locking mechanism 72, and spring 70 provide for the quick-release of the shiftable arm 26 from the retracted position to the extended position by simply depressing button 28. FIG. 6 shows locking mechanism 72 in a locked position with wide portion 80 engaging wide end 78 and holding shiftable arm 26 in the retracted position. To shift locking mechanism 72 from the locked position to the unlocked position a manual force can be applied to depress button 28. FIG. 7 shows locking mechanism 72 in an unlocked position with button 28 being depressed, wide portion 80 being disengaged from wide end 78, and resilient bar 64 being yieldably flexed. FIG. 8 shows locking mechanism 72 in an unlocked position and shiftable arm 26 in the extended position. When locking mechanism 72 is in the unlocked position, narrow portion 82 of locking mechanism 72 is received in the narrow section of slot 76 defined by sides 84 and 86 and wide portion 80 of locking mechanism 72 extends at least partly over sides 84 and 86 to thereby maintain resilient bar 64 in a yieldably flexed position when locking mechanism is not in the locked position. Thus, resilient bar 64 is operable to urge locking mechanism 72 towards the locked position.

To shift shiftable arm 26 from the extended position to the retracted position an external manual force can be applied to shiftable arm 26 to overcome the force provided by spring 70. When the shiftable arm 26 is pushed into the retracted position, shown in FIGS. 6 and 7, resilient bar 64, being yieldably flexed, automatically shifts wide portion 80 of locking mechanism 72 into wide end 78 of slot 76 to thereby lock shiftable arm 26 in the retracted position.

Assembling adjustable frame 26 is relatively simple. To couple fixed arm 24 to body 22, base 40 and resilient bar 50 are simply slid into channel 30 until projection 52 is aligned with hole 54. While being slid into channel 30 projection 52 contacts the interior surface of handle facing wall 34 thereby causing resilient bar 50 to be yieldably flexed. Once projection 52 is aligned with hole 54, resilient bar 50, being yieldably flexed, forces projection 52 to snap into hole 54 and thereby fix arm 24 relative to body 22. To couple shiftable arm 26 to body 22, spring 70 is positioned between stop 68 and inner face 66, and base 56 is slide into channel 30 at the opposite end of body 22 from which fixed arm 24 is coupled. Once base 56 is received in body 22 so that shiftable arm 26 is in the retracted position, locking mechanism 72 can be extended through wide end 78 of slot 76 and attached to resilient bar 64 by rotating locking mechanism 72 so that threaded portion 74 threadably engages resilient bar 64.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. An adjustable frame for holding a paint roller, said frame comprising:

a body;

a shiftable arm shiftably coupled to the body and adapted to at least partially support the paint roller; and a biasing mechanism for automatically shifting the shiftable arm relative to the body when the biasing mechanism is actuated, said shiftable arm being shiftable relative to the body between an extended position and a retracted position, said biasing mechanism operable to urge the arm toward the extended position.

2. An adjustable frame as claimed in claim 1, said biasing mechanism comprising a spring.

3. An adjustable frame as claimed in claim 1, and a locking mechanism for releasably coupling the shiftable arm to the body when the shiftable arm is in the retracted position.

4. An adjustable frame as claimed in claim 3, said locking mechanism including a depressible button operable to selectively release the locking mechanism and thereby actuate the biasing mechanism when the button is depressed.

5. An adjustable frame as claimed in claim 4, said body defining a slot, said locking mechanism at least partly received in the slot, said locking mechanism coupled to the shiftable arm.

6. An adjustable frame as claimed in claim 5, said locking mechanism including a wide portion and a narrow portion, said slot having a wide end and a narrow section, said wide portion of the locking mechanism engaging the wide end of the slot when the shiftable arm is locked in the retracted position to thereby hold the shiftable arm in the retracted position.

7. An adjustable frame as claimed in claim 6, said depressible button operable to disengage the wide portion of the locking mechanism from the wide end of the slot when the button is depressed.

8. An adjustable frame as claimed in claim 7, said narrow portion of the locking mechanism at least partly slidably received within the narrow section of the slot when the shiftable arm is shifted.

9. An adjustable frame for holding a paint roller, said frame comprising:

an elongated body presenting first and second ends;

a fixed arm fixedly coupled to the first end of the body;

a shiftable arm coupled to the second end of the body and shiftable relative to the body between an extended position and a retracted position;

a biasing mechanism operable to urge the shiftable arm toward the extended position; and a selectively releasable locking mechanism shiftable between a locked position in which the shiftable arm is locked in the retracted position and an unlocked position in which the shiftable arm may be shifted into the extended position by the biasing mechanism.

10. An adjustable frame as claimed in claim 9, said body being generally tubular in shape, said shiftable arm including a base portion at least partly slidably received in the body.

11. An adjustable frame as claimed in claim 10, said shiftable arm including an end portion extending transverse to the direction of elongation of the body.

12. An adjustable frame as claimed in claim 10, said biasing mechanism at least partially disposed in the body.

13. An adjustable frame as claimed in claim 12, said biasing mechanism comprising a spring.

14. An adjustable frame as claimed in claim 13; and a stop at least partially disposed in the body and fixedly coupled thereto, said base portion presenting an inner face, said spring interposed between and engaging the stop and the inner face.

15. An adjustable frame as claimed in claim 14, said spring being compressed between the stop and the inner face when the shiftable arm is in the retracted position.

16. An adjustable frame as claimed in claim 9; and a resilient bar coupled to the shiftable arm and operable to urge the locking mechanism toward the locked position.

17. An adjustable frame as claimed in claim 16, said locking mechanism including a depressible button coupled to the resilient bar, said button operable to flex the resilient bar and thereby shift the locking mechanism into the unlocked position when the button is depressed.

18. A paint roller holder couplable to an elongated handle, said paint roller holder comprising:

a handle-receiving socket adapted to receive the elongated handle;

an elongated tubular body fixedly coupled to the handle-receiving socket, said body configured so that the direction of elongation of the body is at least substantially perpendicular to the direction of elongation of the handle, said body presenting first and second open ends;

a fixed arm fixedly coupled to the first end and extending away from the body in a direction which is transverse to the direction of elongation of the body;

a shiftable arm at least partly received in the second end and extending away from the body in a direction which is transverse to the direction of elongation of the body, said shiftable arm being shiftable relative to the body between an extended position and a retracted position, said shiftable arm presenting an inner face;

a stop fixedly coupled to the body proximate the second end;

a spring disposed between the inner face and the stop and operable to urge the shiftable arm towards the extended position;

a selectively releasable locking mechanism operable to lock the shiftable arm in the retracted position; and a depressible button coupled to the locking mechanism and operable to release the locking mechanism to thereby allow the shiftable arm to be shifted into the extended position when the button is depressed.

* * * * *